US009631807B2

(12) United States Patent
Stone

(10) Patent No.: US 9,631,807 B2
(45) Date of Patent: Apr. 25, 2017

(54) CONTINUOUS ULTRAPURE STEAM GENERATOR

(71) Applicant: University Research Glassware Corporation, Chapel Hill, NC (US)

(72) Inventor: Jonathan L. Stone, Chapel Hill, NC (US)

(73) Assignee: UNIVERSITY RESEARCH GLASSWARE CORPORATION, Chapel Hill, NC (US)

( * ) Notice: Subject to any disclaimer, the term of this patent is extended or adjusted under 35 U.S.C. 154(b) by 290 days.

(21) Appl. No.: 14/493,140

(22) Filed: Sep. 22, 2014

(65) Prior Publication Data

US 2016/0084495 A1 Mar. 24, 2016

(51) Int. Cl.
*B01D 3/06* (2006.01)
*F22B 1/28* (2006.01)

(52) U.S. Cl.
CPC ..... *F22B 1/288* (2013.01)

(58) Field of Classification Search
None
See application file for complete search history.

(56) References Cited

U.S. PATENT DOCUMENTS 3,563,212 A * 2/1971 Hoagland ..... F22B 27/14 122/250 R
3,688,083 A * 8/1972 Rice ..... F22B 1/28 338/223
3,826,895 A * 7/1974 Schladitz ..... F24H 1/101 338/205
3,828,161 A * 8/1974 Yamaguchi ..... C04B 35/565 252/504
3,934,117 A * 1/1976 Schladitz ..... F24H 1/105 338/205
3,943,330 A * 3/1976 Pollock ..... F04F 9/00 219/553
4,030,456 A 6/1977 Corpus
4,288,396 A * 9/1981 Ottestad ..... B63C 11/28 128/203.27
4,311,189 A 1/1982 Robin
4,419,302 A 12/1983 Nishino et al.
4,795,618 A * 1/1989 Laumen ..... B01J 8/0285 422/202
5,100,609 A * 3/1992 Oosterkamp ..... G21C 7/32 376/209
5,117,482 A * 5/1992 Hauber ..... H05B 3/148 239/135

(Continued)

FOREIGN PATENT DOCUMENTS

WO WO8802087 3/1988

*Primary Examiner* — Thor Campbell
(74) *Attorney, Agent, or Firm* — Thomas Schneck

(57) ABSTRACT

A generator of ultrapure steam and a corresponding steam generating method uses a heated, fritted refractory glass plate as a water-to-steam interface dividing a first chamber, with water on one side of the plate and steam on the other. Water is continuously injected into interstices of the plate, held fixed in the chamber, where the water evaporates and migrates upwardly to where a steam cloud is formed that exits the chamber and into a second chamber that is a saturation housing where an air stream removes steam from the exit, preventing steam condensation, and delivering a steam jet out of the housing through a port.

8 Claims, 2 Drawing Sheets

(56) References Cited

U.S. PATENT DOCUMENTS

| | | | | | |
|---|---|---|---|---|---|
| 5,267,584 | A * | 12/1993 | Smith | G05D 7/0629 | 137/13 |
| 5,344,622 | A * | 9/1994 | Faddis | A61L 2/24 | 219/396 |
| 5,943,859 | A | 8/1999 | Kawamura | | |
| 5,963,709 | A * | 10/1999 | Staples | F24H 1/101 | 392/379 |
| 6,169,852 | B1 * | 1/2001 | Liao | F22B 1/284 | 261/142 |
| 6,299,076 | B1 | 10/2001 | Sloan et al. | | |
| 6,647,204 | B1 | 11/2003 | Hutchinson | | |
| 6,732,569 | B2 * | 5/2004 | Ondov | G01N 1/2273 | 73/23.2 |
| 6,990,930 | B2 | 1/2006 | Sarkar | | |
| 7,146,795 | B2 | 12/2006 | Pelini | | |
| 7,971,862 | B2 * | 7/2011 | Kanda | F22B 1/28 | 261/128 |
| 9,338,828 | B2 * | 5/2016 | McGuffey | H05B 3/16 | |
| 2002/0134137 | A1 * | 9/2002 | Ondov | G01N 1/2273 | 73/28.05 |
| 2004/0234445 | A1 * | 11/2004 | Serp | B01J 23/745 | 423/447.3 |
| 2010/0074603 | A1 * | 3/2010 | Balch | A61M 11/041 | 392/387 |
| 2013/0323139 | A1 | 12/2013 | Batt et al. | | |
| 2013/0334465 | A1 | 12/2013 | Zhao et al. | | |

* cited by examiner

CONTINUOUS ULTRAPURE STEAM GENERATOR

TECHNICAL FIELD

The invention relates to steam generation and, in particular, to an apparatus producing a continuous jet of ultrapure steam.

BACKGROUND ART

In PCT application WO 88/02087, published Mar. 10, 1988 by Michael Laumen, a steam generator is disclosed having a porous sintered metal block in a housing as a steam generation element. The sintered block is electrically heated to a predetermined temperature so that steam is formed and then directed out of the housing.

FIG. 1 is a simplified Laumen steam generator of the type described in publication WO 88/02087. The apparatus uses a sintered metal block 12 in a conical housing 14 as a steam generating element. The sintered metal block 12 has metal grain size and porosity optimized for steam generation. The block divides the conical housing, receiving pressurized water from a water feed 18 to form a water layer 22 below the block. Pressure forces water from the layer 22 into pores of the sintered metal block, with the metal selected for good heat conductivity.

An electrical heater 16 is a coil that heats the block by conduction through the housing wall and into the block thereby causing evaporation of the water in the pores of the block upwardly into the steam chamber 32. A temperature probe 26 measures the temperature of evaporating water and applies electricity from electrical power source 42 to the coils as needed to form steam. A water supply 34 sends water to a filter 36 for purification and then to pressurizing pump 38 to supply the water feed 18 to form the water layer 22 below the metal block, with the upper portion of the water layer 22 entering the block. A heat exchanger 20 cools the outside of the housing 14 to recover outward conduction of heat from the coil. Meanwhile, continuing layers of water, converted to steam, form a cloud of steam in steam chamber 32, then exit the housing through the steam vent tube 40. The vent tube has a feedback loop, not shown, to the pump 38 so that steam output may be regulated to a desired amount and another feedback loop 46 regulating power to coil 16 for regulating heat.

While the Laumen steam generator is very good for producing desired amounts of steam, a problem is that the quality of the steam is not suitable for some applications, particularly for scientific or medical laboratory applications where very pure steam is desired. This problem arises because in the metal sintering process, fine particles of carbon or metal or metal compounds are formed that can occupy the interstices of the granular metal block. Some of these fine particles are picked up by the steam in the evaporation process. What is needed is a steam forming method that produces ultrapure steam for scientific or medical laboratory applications.

SUMMARY OF INVENTION

The invention is a steam generator made of water and steam inert materials for producing ultra pure steam. In particular, it has been found that fritted glass will serve to transform injected pure water into pure steam on opposite sides of a fritted refractory glass plate in a chamber. A fritted glass member or plate divides a plenum formed in the chamber into lower and upper chamber regions. An injector feeds purified water into the fritted glass member that is heated by an electrical heater coil surrounding the glass member on the outside of the chamber. The purified water migrates upwardly via interstices in the fritted glass plate, evaporating due to the elevated temperature of the glass member. The evaporating water moves into the upper chamber region where it is directed to a steam exhaust sleeve of the chamber that is connected to a saturation housing made of steam inert material, such as glass. The saturation housing has pressurized air blowing through the housing past the steam exhaust sleeve where the air becomes saturated by condensing steam and prevents condensation on wall surfaces. The pressurized air forms a steam jet toward a steam delivery port of the saturation housing. The water injector may be a syringe driven by a stepper motor to maintain a constant, accurately metered flow of water that can be adjusted on command for conversion to a desired steam volume in the steam jet. The resulting steam jet contains ultrapure steam.

DESCRIPTION OF INVENTION

Applicant has produced ultrapure steam by use of inert materials that interface with water and steam in a steam generator. Applicant discovered that fritted glass can be used to convert injected pure water into ultrapure steam.

Figure 1:
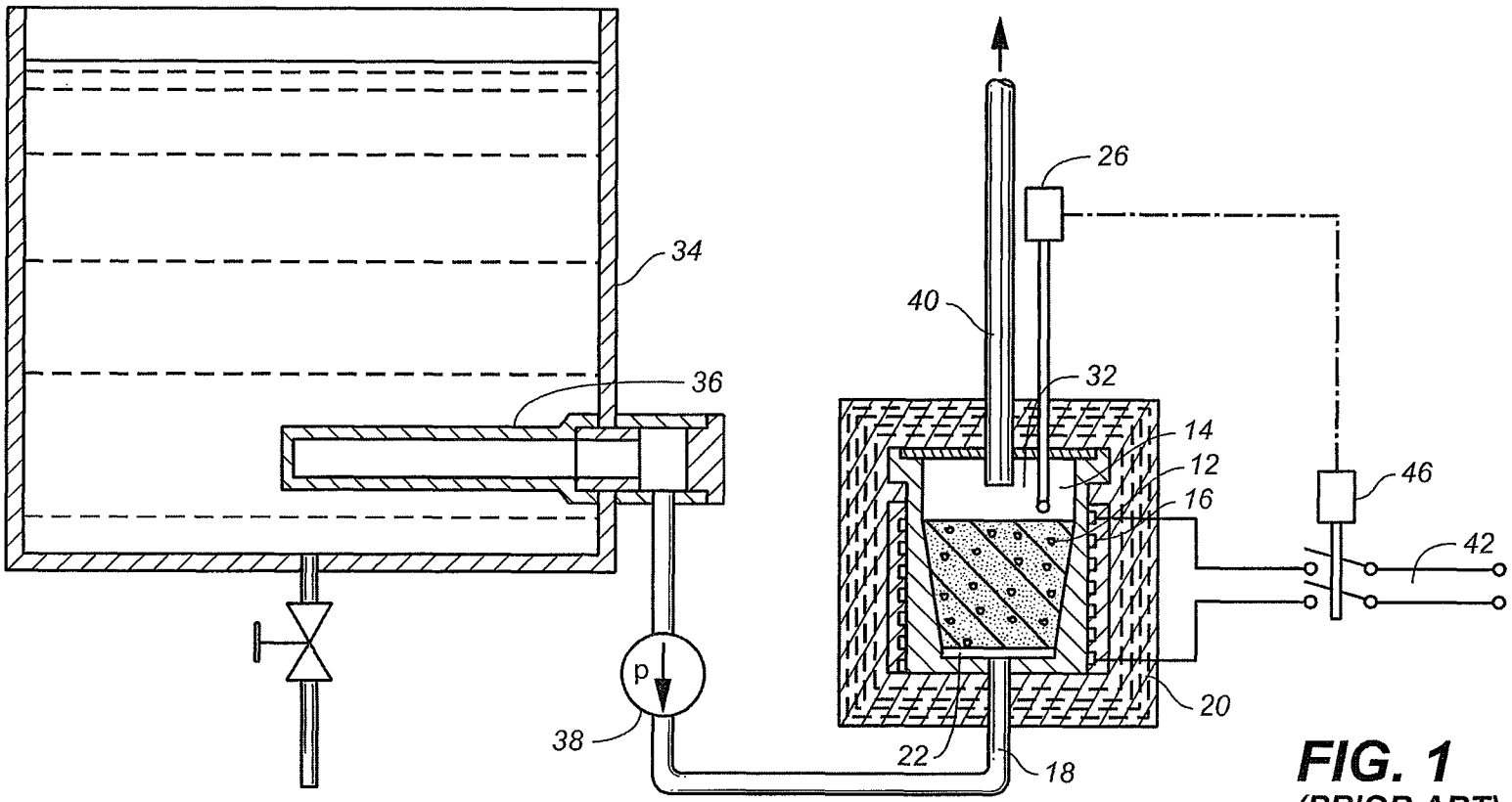
FIG. 1 (PRIOR ART)
FIG. 1 is a plan view of a Laumen steam generator of the prior art.
Figure 2:
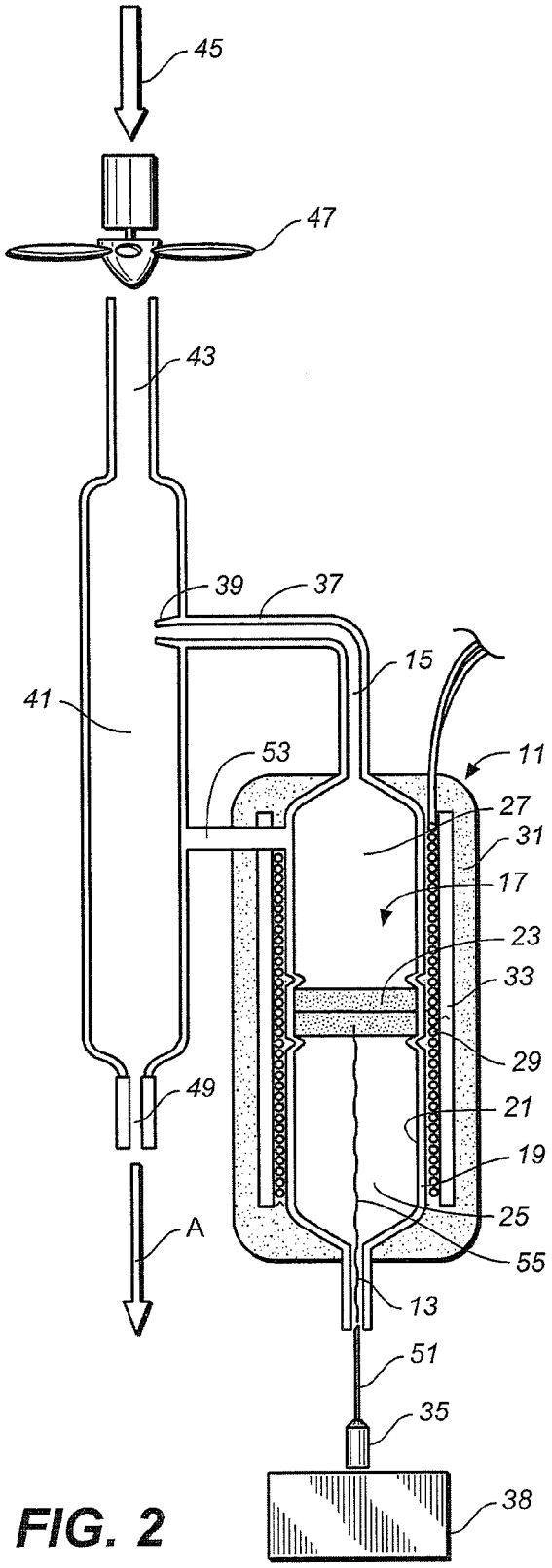
FIG. 2 is a plan view of the present invention.

With reference to FIG. 2, a steam generator 11 has water and steam contacting parts that are made of glass, ceramic or similar high temperature, chemically inert materials that are free of contaminants. A high temperature glass steam chamber 11 is seen to be cylindrical with an axis of symmetry and an axial water input sleeve 13 at a lower terminus and an axial steam exhaust sleeve 15 at an upper terminus. High temperature glass with a 1.5 mm wall thickness may be a low thermal expansion borosilicate glass, or tempered soda lime glass. Such glass is sometimes sold under the Pyrex trademark. Each sleeve may be shaped as a luer connection, i.e. having a slight taper for accommodating tubing with a compression fit. The chamber has a cylindrical outer chamber wall 19 and an inner cylindrical chamber wall 21.

The central portion of chamber 11 is a plenum 17 that is divided by a fritted glass or porous refractory glass plate member 23 into a lower chamber region 25 and an upper chamber region 27. The refractory fritted glass plate member 23 is disc or plate shaped, molded for spanning the interior circumference of the chamber 11, blocking fluid communication from the lower chamber region to the upper chamber region except as described below. The glass member 23 is not fused to the chamber, but wedged between chamber wall interior detents for mechanical support. The member has inherent microscopic porosity from the fritting process and a sufficient pore density to allow water vapor communication through the glass member 23 from the side facing the lower chamber upwardly to the side facing the upper chamber. Porosity is in the range of 170 to 200 microns.

An electrical heater coil 29 surrounds the outer chamber wall 19 in the vicinity of the refractory fritted glass member 23 proximate to the circumferential periphery of the refractory glass member and in close heat transfer relation. The heater coil is made of a helical coil of Nichrome wire, similar to wire found in electrical toasters. The wire, having high electrical resistance, has spaced apart turns and glows red hot when a DC current passes through the wire and transfers constant heat to the frits by conduction and radiation to the nearby refractory fritted glass member 23. Heat flows radially inwardly from the heater coil toward the center of the refractory glass member. Water that is injected into pores of the refractory fritted glass member tends to evaporate and be communicated through interstices of the glass member toward the upper chamber region 27. Fritted glass of the type described can be purchased commercially. Energy input via the heater coil is about 2400 joules per ml of water.

A ceramic jacket 31, made of a castable or molded silica ceramic, surrounds the chamber 11 to provide outward thermal insulation and to retain heat in the inward portion of the steam generator. The ceramic jacket has a cylindrical dead space 33, i.e. an air gap, radially outwardly of the heater coil 29, and axially coextensive with the heater coil, to partially block heat transfer by conduction into the ceramic jacket. The radial extent of the dead space is only one or perhaps a few millimeters, but the dead space diverts heat into the refractory glass member 23, allowing the outside of the ceramic jacket, which is a few centimeters thick, to be sufficiently cool that the outside of the jacket can be handled without injury.

A water injector 35 is a precision syringe pump with a tubular water input tube 51 and a water jet 55 extending from the injector into the water input sleeve 13 toward the refractory glass member 23. Water jet 55 will penetrate the fritted member 23 in a hemispheric pattern, with the shortest water path being forward and longer paths being partly radial. Input water flow rate is about 12.8 mL/Hr. Note that the radial zones are hotter due to proximity to the heater coil 29. The higher temperature of the radially outward zones of the refractory glass member favors greater evaporation, but the longer flow paths reduce volume. On the other hand, the shorter forward paths are in cooler zones of the refractory glass member and so evaporation is at a lower rate but the short flow path favors an increased volume. The net result is a thickness of the refractory glass member can be selected for a particular chamber having generally uniform evaporation across the upper surface of the block. Water flow into the injector 35 is adjusted by a stepper motor 38 so that water flows continuously toward the refractory glass member 23. No layer of water forms near the glass plate member. There would be a risk of boiling that could be explosive. Excess water flows out of the water input sleeve 13. Calibration can establish a water input rate for desired continuous steam output through the steam exhaust sleeve 15.

Steam in the steam exhaust sleeve 15 goes into the steam vent tube 37 having an orifice 39 that extends into a glass saturation housing 41. The saturation housing may be mechanically supported from the steam chamber 11 by support arm 53 and has an air input port 43 where an air stream 45 is directed with a flow rate and pressure established by fan 47. The air stream flow rate is sufficient to allow steam condensation in air but to prevent condensation of steam on surfaces in the saturation housing and preferably to saturate the air stream with steam. A typical ratio of air flow mass to injected water volume is 14,063 ml air to 1 ml water. The orifice 39 is shaped and placed in the air stream so that low pressure draws steam out of the steam vent tube 37 by the Bernoulli effect, avoiding condensation at the tip of the vent tube. Steam in the air stream is delivered from the steam delivery port 49 that may be shaped as a luer connection. Steam delivery is represented by arrow A.

The invention contemplates that input water flow rate can be established by calibration for continuous flow of both water input and steam output. All components that contact water and steam are made of high temperature glass, essentially chemically inert materials, so that where pure water is input via the water injector 35, pure steam, free of particles and contaminants, results.

What is claimed is:

1. A steam generator comprising:

a chamber made of steam inert material having a water input sleeve, a steam exhaust sleeve and a plenum therebetween, with an outer chamber wall and an inner chamber wall;

a heated porous refractory glass member dividing the plenum into a lower chamber region and an upper chamber region;

an electrical heater coil surrounding a portion of the outer chamber wall of the plenum in heat transfer relation with the porous refractory glass member to steam forming temperatures within the porous glass member;

a ceramic jacket surrounding the electrical heater coil and the outer chamber wall in a heat insulative manner, with a dead space separating the coil from the jacket thereby reducing heat transfer from the coil to the jacket;

an injector feeding purified water through the chamber water input sleeve into the heated porous refractory glass member whereupon the chamber exhaust sleeve vents steam from the porous member; and a hollow saturation housing having a pressurized air input port, a steam delivery port and an intermediate aperture connected to the chamber steam exhaust sleeve for receiving steam into the saturation housing;

whereby steam from the chamber steam exhaust sleeve is mixed with air from the pressurized air input port for air saturation with steam and pressurized egress via the housing steam delivery port.

2. The apparatus of claim 1 wherein the porous refractory material is fritted glass.

3. The apparatus of claim 1 wherein the water injector is a stepper driven continuously fed syringe.

4. The apparatus of claim 1 wherein the chamber is cylindrical and the porous refractory material is disk shaped.

5. A steam generator comprising:

an elongated chamber made of steam inert material having an axis with an axial water input sleeve, an axial steam exhaust sleeve and a plenum therebetween, with a cylindrical outer chamber wall and a cylindrical inner chamber wall;

a heated porous refractory fritted member dividing the plenum into a lower chamber region and an upper chamber region;

an electrical heater coil surrounding a portion of the outer chamber wall of the plenum in heat transfer relation with the porous refractory fritted member to steam forming temperatures within the porous fritted member;

a cylindrical ceramic jacket surrounding the electrical heater coil and the outer chamber wall in a heat insulative manner, with a cylindrical dead space separating the coil from the jacket thereby reducing heat transfer from the coil to the jacket;

an injector feeding purified water through the chamber water input sleeve into the heated porous refractory fritted member whereupon the chamber exhaust sleeve vents steam from the porous member; and a hollow saturation housing having a pressurized air input port, a steam delivery port and an intermediate aperture connected to the chamber steam exhaust sleeve for receiving steam into the saturation housing;

whereby steam from the chamber steam exhaust sleeve is mixed with air from the pressurized air input port for air saturation with steam and pressurized egress via the housing steam delivery port.

6. The apparatus of claim 5 wherein the fritted member is fritted glass.

7. The apparatus of claim 5 wherein the fritted member is disk shaped.

8. A method of generating steam comprising:

converting water into steam through a fritted glass member in a first chamber by directing water into the fritted glass member using a stepper driven continuously fed syringe; and directing steam from the first chamber into a second chamber having an air stream passing therethrough, the air stream carrying steam out of the second chamber in a steam jet.

* * * * *